US010627087B2

(12) United States Patent
Morton

(10) Patent No.: US 10,627,087 B2
(45) Date of Patent: Apr. 21, 2020

(54) LIGHT FIXTURE INCLUDING ELECTRIC CONDUIT FORMED FROM ANTLERS

(71) Applicant: Daniel Morton, Hendersonville, NC (US)

(72) Inventor: Daniel Morton, Hendersonville, NC (US)

(73) Assignee: Daniel Timothy Morton, Inman, SC (US)

( * ) Notice: Subject to any disclaimer, the term of this patent is extended or adjusted under 35 U.S.C. 154(b) by 0 days.

(21) Appl. No.: 16/513,023

(22) Filed: Jul. 16, 2019

(65) Prior Publication Data

US 2020/0018466 A1 Jan. 16, 2020

Related U.S. Application Data

(60) Provisional application No. 62/698,445, filed on Jul. 16, 2018.

(51) Int. Cl.

| | |
|---|---|
| ***F21V 23/00*** | (2015.01) |
| *F21S 8/06* | (2006.01) |
| *F21S 8/00* | (2006.01) |
| *F21S 6/00* | (2006.01) |

(52) U.S. Cl.

CPC ..... *F21V 23/002* (2013.01); *F21S 6/002* (2013.01); *F21S 6/005* (2013.01); *F21S 8/033* (2013.01); *F21S 8/065* (2013.01)

(58) Field of Classification Search

CPC ..... F21V 23/002; F21S 6/002; F21S 6/005; F21S 8/033; F21S 8/065

See application file for complete search history.

(56) References Cited

U.S. PATENT DOCUMENTS

| | | | | |
|---|---|---|---|---|
| 2,197,887 A * | 4/1940 | Elting | F21S 8/06 248/342 |
| 9,587,821 B2 * | 3/2017 | Carroll | B44C 5/02 |
| 2016/0369999 A1 * | 12/2016 | La Roque | F21V 23/0471 |

* cited by examiner

*Primary Examiner* — Anh T Mai
*Assistant Examiner* — Nathaniel J Lee
(74) *Attorney, Agent, or Firm* — William G. Heedy; The Van Winkle Law Firm

(57) ABSTRACT

A light fixture having an antler arm portion includes a main body member; a plurality of channels each defining an electrical conduit formed on the antler arm portion, each of the electrical conduits extending outwardly from said main body member and being sized and configured for wiring of an electric light element; each of said plurality of electric light elements being sized and configured for being secured to a distal end of a respective one of said plurality of electrical conduits; and wherein each of said plurality of electric light elements includes a bulb base and a replaceable light bulb, wherein each one of said bulb bases is affixed to the distal end of a corresponding one of the plurality of electrical conduits.

6 Claims, 1 Drawing Sheet

LIGHT FIXTURE INCLUDING ELECTRIC CONDUIT FORMED FROM ANTLERS

RELATED APPLICATION

This application claims priority to and incorporates entirely by reference U.S. Provisional Patent Application Ser. No. 62/698,445 filed on Jul. 16, 2018.

FIELD OF INVENTION

This invention relates to light fixtures and, more particularly, a light fixture including a plurality of electric conduits formed using antlers.

BACKGROUND OF THE INVENTION

Presently, the majority of decorative light fixtures including an antler element are actually faux antlers or, alternatively, real antlers wherein the antlers do not serve as electric conduits due to the composition of antlers and/or include patching. There exists a need in the art for a light fixture, such as chandeliers, sconces, floor lamps and table lamps, including an electric conduit formed from antlers.

BRIEF DESCRIPTION OF THE DRAWINGS

For a fuller understanding of the nature of the present invention, reference should be made to the following detailed description, taken in conjunction with the accompanying drawings in which.

SUMMARY OF THE INVENTION

In accordance with one form of this invention, there is provided a light fixture including an antler arm portion, said light fixture including a main body member; a plurality of channels each defining an electrical conduit formed on the antler arm portion, each of the electrical conduits extending outwardly from said main body member and being sized and configured for wiring of an electric light element; each of said plurality of electric light elements being sized and configured for being secured to a distal end of a respective one of said plurality of electrical conduits; and wherein each of said plurality of electric light elements includes a bulb base and a replaceable light bulb, wherein each one of said bulb bases is affixed to the distal end of a corresponding one of the plurality of electrical conduits. Multiple embodiments of the light fixture are considered, such as chandeliers, sconces, floor lamps and table lamps.

DETAILED DESCRIPTION OF THE PREFERRED EMBODIMENT

Figure 1:
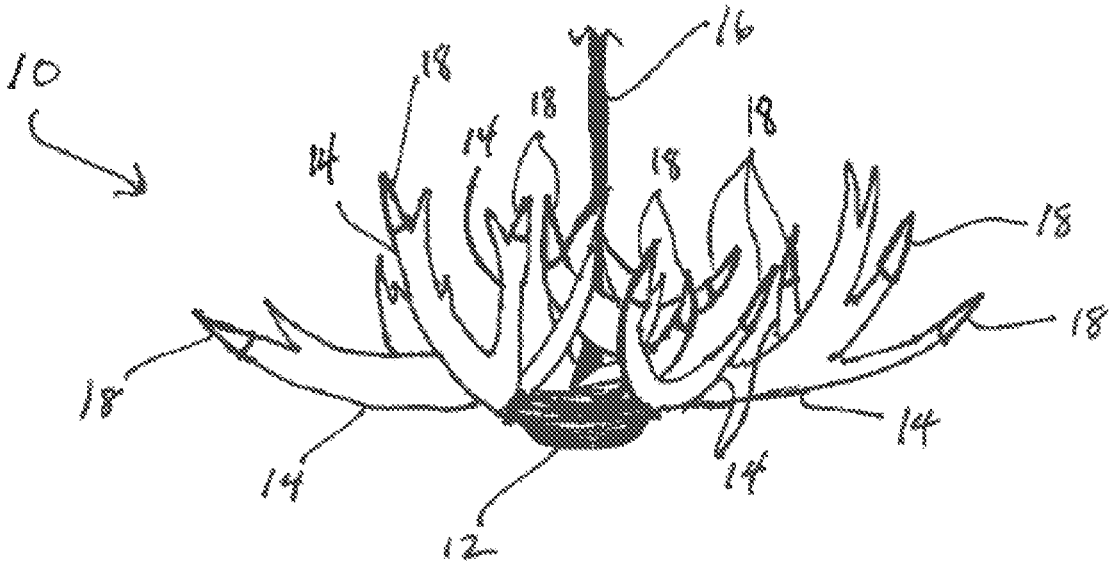
FIG. 1 is a perspective view of the light fixture including electric conduit formed from antlers.

Referring initially to FIG. 1, the light fixture 10 includes a main body member 12 with a plurality of antler arms 14 and a vertical supporting element 16 extending therefrom. One or more of the antler arms 14 includes an electric light element 18 at a distal end of the corresponding antler arm 14.

Figure 2:
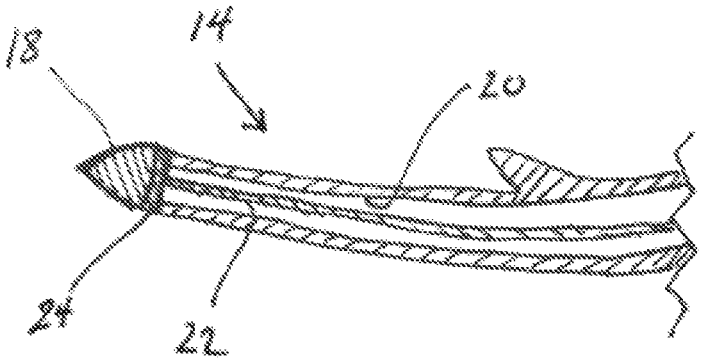
FIG. 2 is an isolated view shown in cross section of the hollowed supporting member formed from an antler.

Referring now to FIG. 2, one or more of the antler arms 14 is hollowed out to form a channel that is sized and configured to serve as an electric conduit 20 for wiring 22 of the electric light element 18. Each light element 18 includes a bulb base 24 affixed to the distal end of a corresponding electrical conduit.

The method of manufacturing the light fixture 10 includes sandblasting, at both the distal end and proximal ends, the antler arms 14 to form the electrical conduits 20. Then the bulb base 24 is affixed to the distal end of the antler arm 14.

Multiple embodiments of the light fixture 10 are considered, such as chandeliers, sconces, floor lamps and table lamps.

From the foregoing description of various embodiments of the invention, it will be apparent that many modifications may be made therein. It is understood that these embodiments of the invention are exemplifications of the invention only and that the invention is not limited thereto.

What is claimed is:

1. A light fixture including an antler arm portion, said light fixture comprising:

a main body member;

a plurality of channels each defining an electrical conduit formed on the antler arm portion, each of the electrical conduits extending outwardly from said main body member and being sized and configured for wiring of an electric light element;

each of said plurality of electric light elements being sized and configured for being secured to a distal end of a respective one of said plurality of electrical conduits; and wherein each of said plurality of electric light elements includes a bulb base and a replaceable light bulb, wherein each one of said bulb bases is affixed to the distal end of a corresponding one of the plurality of electrical conduits.

2. The light fixture as recited in claim 1 further comprising a vertical supporting element extending from said main body member.

3. The light fixture as recited in claim 1 wherein said light fixture is a chandelier.

4. The light fixture as recited in claim 1 wherein said light fixture is a sconce.

5. The light fixture as recited in claim 1 wherein said light fixture is a floor lamp.

6. The light fixture as recited in claim 1 wherein said light fixture is a table lamp.

* * * * *